US005234040A

United States Patent [19]

Koba

[11] Patent Number: 5,234,040

[45] Date of Patent: Aug. 10, 1993

[54] VENEER DEHYDRATING APPARATUS

[75] Inventor: Yoshinori Koba, Obu, Japan

[73] Assignee: Meinan Machinery Works, Inc., Obu, Japan

[21] Appl. No.: 950,445

[22] Filed: Sep. 22, 1992

[30] Foreign Application Priority Data

Sep. 27, 1991 [JP] Japan ..... 3-276578

[51] Int. Cl.[5] ..... B27M 1/02; B30B 9/20

[52] U.S. Cl. ..... 144/2 R; 100/121; 100/176; 144/2 J; 144/362; 492/30

[58] Field of Search ..... 144/2 R, 2 J, 361, 362; 100/98 R, 121, 176, 902; 492/30, 32

[56] References Cited

U.S. PATENT DOCUMENTS 3,125,141 3/1964 Best et al. ..... 144/2 J
4,691,629 9/1987 Koba .
4,718,338 1/1988 Koba .
4,868,958 9/1989 Suzuki et al. ..... 492/32

*Primary Examiner*—W. Donald Bray
*Attorney, Agent, or Firm*—Brooks Haidt Haffner & Delahunty

[57] ABSTRACT

A veneer dehydrating apparatus is disclosed. The apparatus includes a pair of rolls disposed so as to form a nip between the peripheries thereof through which a green veneer sheet is passed. At least one of the rolls has on its periphery a number of tooth-like projections separated from one another by grooves formed on the roll periphery. Each projection is pierceable into a veneer sheet to squeeze out part of water contained in the veneer sheet by compression exerted thereto by the projection piercing thereinto. The toothed roll has an elastic filler member fitted round the roll so as to fill the spaces between the projection. The elastic filler member comprises an elastic portion made of, e.g., sponge rubber and a reinforcement portion made of, e.g., fabric and secured to one surface of the elastic portion and seated firmly against the radially innermost surface of the grooves.

8 Claims, 7 Drawing Sheets

VENEER DEHYDRATING APPARATUS

BACKGROUND OF THE INVENTION

The present invention relates generally to a veneer dehydrating apparatus having a pair of rolls, at least one of which is a toothed roll, though which a sheet of green wood veneer is passed for squeezing part of water contained in that veneer sheet. More specifically, it relates to a novel structure of reinforced elastic filling member used in conjunction with the toothed roll to improve the veneer dehydrating efficiency of the apparatus.

BACKGROUND OF THE INVENTION

A veneer dehydrating apparatus is known in the art which includes a roll having on its periphery a number of tooth-like projections pierceable into a veneer sheet to exert compression adjacent its pierced locations, thereby squeezing out part of the moisture contained in the green veneer sheet. Typical apparatuses are disclosed, e.g., in U.S. Pat. Nos. 4,691,629 and 4,718,338 both of which were assigned to the same assignee as the present application. The latter publication discloses a veneer dehydrating apparatus which has a pair of toothed rolls spaced apart so as to form therebetween a nip along their axial length through which a veneer sheet is passed, and each having on its periphery a number of projections formed integral with the rolls. The paired rolls are rotatable in opposite directions to allow a veneer sheet to be moved forward through their nip and spaced such that the clearance at the nip between the radially outermost tip ends of two adjacent projections, one on each of the two rolls, is about 20% to 60% of the veneer sheet thickness and the clearance at said nip between the radially innermost base surfaces, one on each of the toothed rolls, between two adjacent projections, is about 90% of the sheet thickness or more. In this apparatus, a veneer sheet pierced by the projections while being passed through the toothed rolls is subjected to compressive deformation over the entire surfaces thereof and adjacent the locations pierced by the projections, which causes part of the water in the veneer sheet to be squeezed out thereof. The above cited Publication also discloses the use of a pair of modified toothed rolls in the above-described apparatus, each of said rolls being fitted round its periphery with elastic material such as sponge rubber so as to fill all projection-to-projection spaces to prevent the squeezed water from flowing toward the delivery side of the nip. Addition of this elastic filling can help improve the dehydrating efficiency of the apparatus because the chance for the squeezed water to be attached to the veneer sheet coming out from the nip and thereby to wet the same can be reduced.

In fitting the elastic filling, i.e. sponge rubber, to the roll periphery, it is customary to make use of rubber-to-metal bonding by vulcanization to ensure tight cohesion. As will be understood, the sponge rubber filling wears or even incurs a damage from pressures exerted by veneer sheets moving through the nip successively and ultimately becomes unserviceable after a prolonged period of use. Thus, the dehydrating rolls must be replaced with new ones on a periodical basis to maintain the desired working efficiency of the apparatus. Since each roll is an expensive part, it is a usual practice to substitute only the filling with new one. However, the rubber-to-metal bonding is not only a costly and time-consuming process, but also it requires laborious efforts in removing the rubber portion from the metal roll with the aid of appropriate solvents before the subsequent installation of new sponge rubber filling on the roll.

To avoid tight bonding of the sponge rubber, the toothed roll may be just wrapped with a sheet of sponge rubber filling pressed round the roll such that the projections cut through the filling sheet and all the spaces between the projections are stuffed with the sponge rubber. Though the use of such readily separable sponge rubber sheet can facilitate its installation and removal, it was found by the inventor that the sheet tended to be sprung out of engagement with the roll periphery when the pressure to press down the rubber was released during dehydrating operation, with the result that the desired veneer dehydration could not be achieved.

SUMMARY OF THE INVENTION

It is an object of the invention, therefore, to provide an veneer dehydrating apparatus which can permit easy installation and removal of elastic filling round a toothed roll of the apparatus while maintaining the desired dehydrating efficiency of the prior art.

A veneer dehydrating apparatus according to the present invention includes a pair of rolls rotatable on the axes thereof and disposed so as to form a nip therebetween along the axial length thereof and conveyer means for feeding green veneer sheets successively into the nip. At least one of the rolls is a toothed roll having on its periphery a number of tooth-like projections which are separated from one another by grooves formed on the roll periphery, and each projection is pierceable into a veneer sheet to squeeze out part of water contained in the veneer by compression exerted thereto by the projection then piercing thereinto. The toothed roll has an elastic filling member fitted round the roll so as to fill the spaces between the projections. The filling member is provided in the form of a sheet, comprising a layer of elastic portion made of, e.g., sponge rubber of such a type that its pores are distributed therein discretely without being connected to each other so that the squeezed water is not absorbed thereby through the pores, and a layer of reinforcement portion which is made of, e.g., fabric with a high tensile strength with little elasticity. The reinforcement portion is secured to one surface of the elastic portion and seated firmly against the radially innermost surfaces of the grooves.

The elastic filler sheet has preferably such a thickness that its radially outer surface lies radially slightly further than the tip ends of the respective projections when fitted round the toothed roll.

For the sake of ease of installing and removing the elastic filling, the toothed roll is preferably made of a plurality of separable roll sections which are axially aligned and combined together thereby to constitute a dehydrating roll assembly.

The above and other objects, features and advantages of the invention will become apparent to those skilled in the art from the following description of a preferred embodiment of the veneer dehydrating apparatus according to the present invention, which description is made with reference to the accompanying drawings, wherein:

DETAILED DESCRIPTION OF PREFERRED EMBODIMENT

Figure 1:
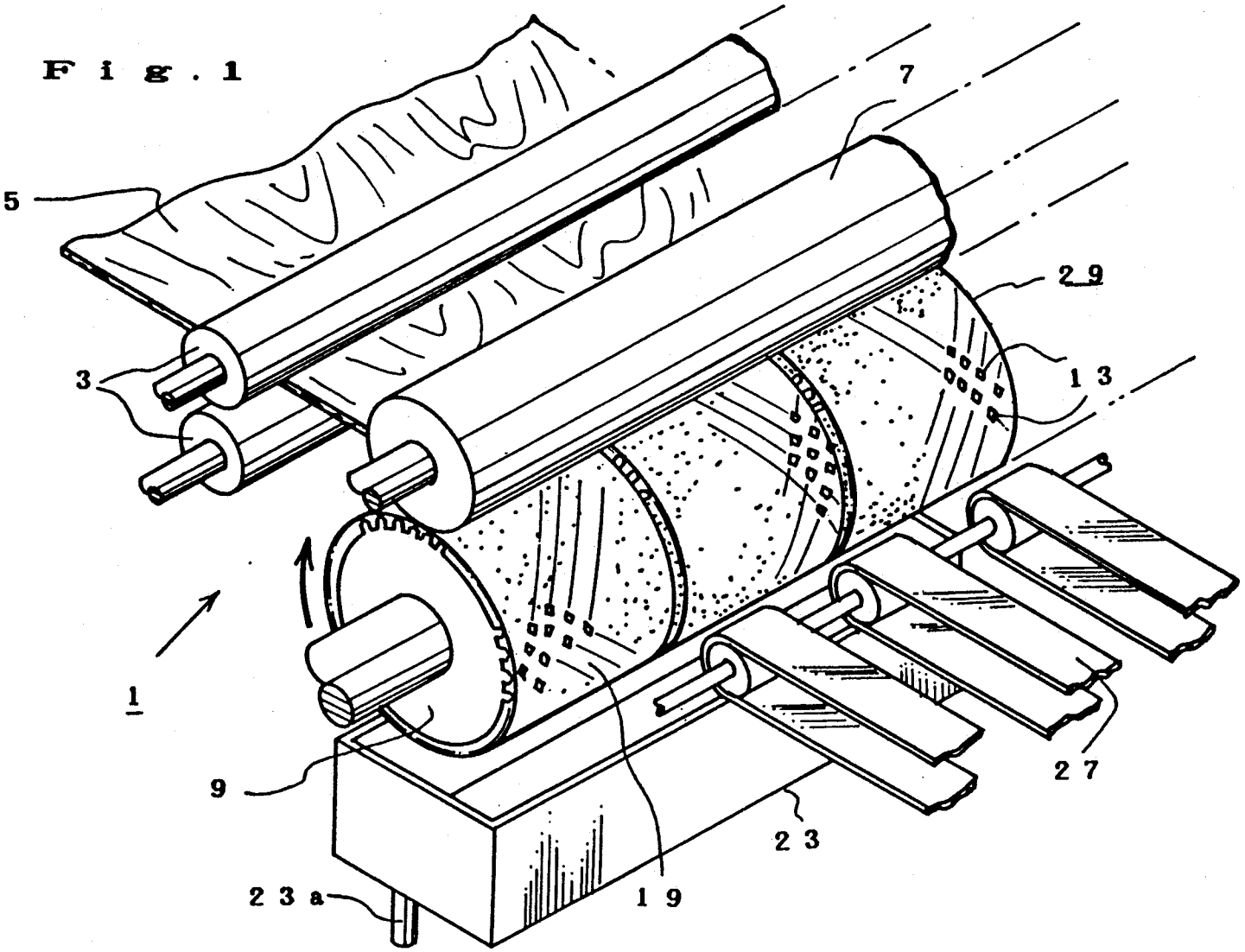
FIG. 1 is a perspective view of a veneer dehydrating apparatus according to an embodiment of the present invention.
Figure 9:
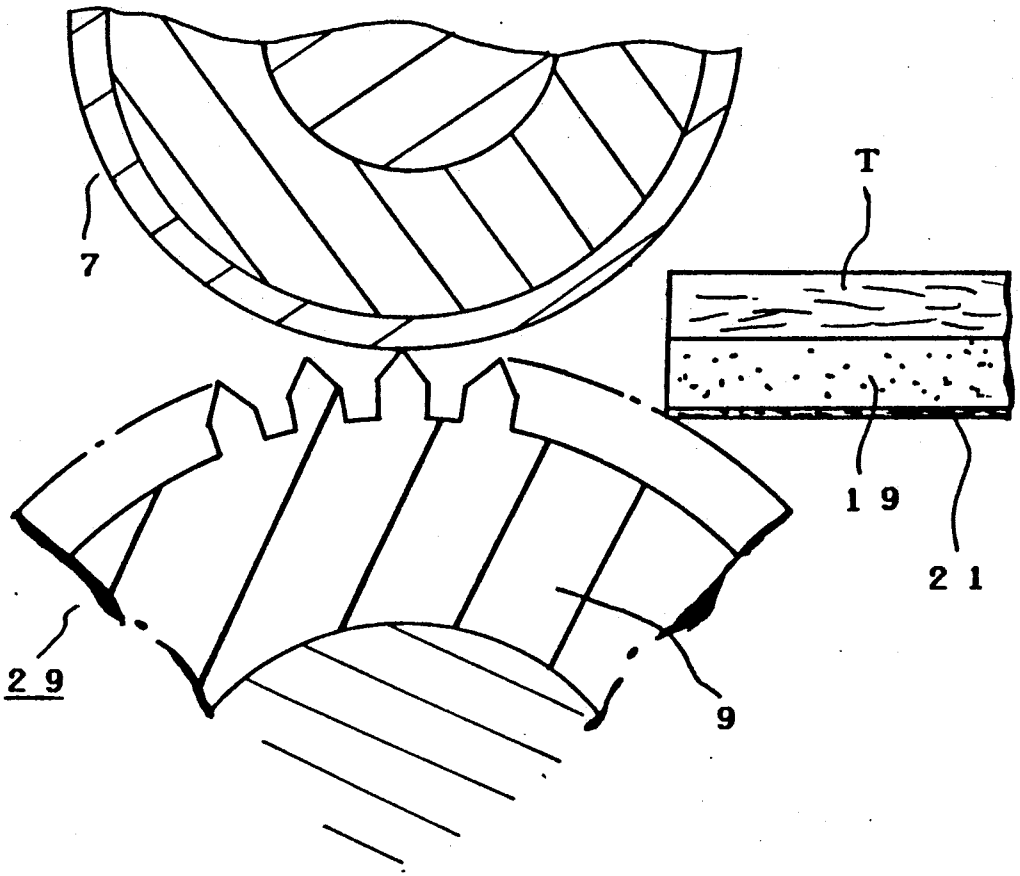
FIG. 9 is a partial cross-sectional view illustrative of a method of installing the elastic filling member round the dehydrating roll.

Referring to FIG. 1 showing a veneer dehydrating apparatus which is generally designated by reference numeral 1, it includes a pair of feeding rolls 3 disposed one above the other for rotation about their axes extending parallel to each other and transverse to the direction in which an incoming veneer sheet 5 is moved. The rolls 3, at least one of which is powered, are spaced radially so as to provide a nip between the peripheries thereof through which the veneer sheet 5 is forced to advance by rotation of the rolls. On the downstream side of the feeding rolls 3 is located another pair of rolls arranged one above the other and extending parallel to the rolls 3, including a toothed dehydrating roll assembly 29 operable in conjunction with its associated top pressing roll 7. The pressing roll 7 is freely rotatably supported by opposite frames (not shown) of the apparatus and has on its periphery a layer of friction material such urethane rubber with Shore hardness of about Hs 90. As indicated by parting lines in FIG. 1, the roll assembly 29 comprises a plurality of axially aligned roll sections 9 each having an axial length of about 110 mm and a number of tooth-like projections 13 over its periphery. The number of the aligned roll sections 9 depends upon the maximum width dimension of veneer sheets that the apparatus can handle. In handling veneer sheets of, e.g., 4-foot nominal width (about 1,219 mm) in the illustrated embodiment, at least twelve roll sections 9 (totaling 1,320 mm in length) are required to make the roll assembly 29 and the upper pressing roll 7 has desirably the same length. The top pressing roll 7 is positioned with respect to the dehydrating roll assembly 29 such that the periphery of the roll 7 is just in contact with the radially outermost tip ends of the projections 13 on each roll section 9, as shown in FIG. 9. A shaft which carries the roll sections 9 is operatively connected to a suitable drive (not shown) for rotation in arrow direction to move an incoming veneer sheet 5 forward through the roll nip. Though the pressing roll 7 in the embodiment is idle, it may be also rotated positively by a drive motor in synchronism with the rotation of the dehydrating roll 29 so that both rolls rotate at the same peripheral speed.

There is provided on the downstream side of the veneer dehydrating station constituted by the paired rolls 7, 29 a delivery conveyer comprising a plurality of conveyer belts 27 for transferring dehydrated veneer sheets successively toward the subsequent process. Below and along the dehydrating roll assembly 29 is located an elongated water receptacle 23 for receiving the squeezed water flowing down from the roll assembly. The receptacle 23 is desirably slightly tilted so that the water received in the receptacle flows out through an outlet tube 23*a* located at one end on the bottom and communicating with the interior thereof.

Figure 2:
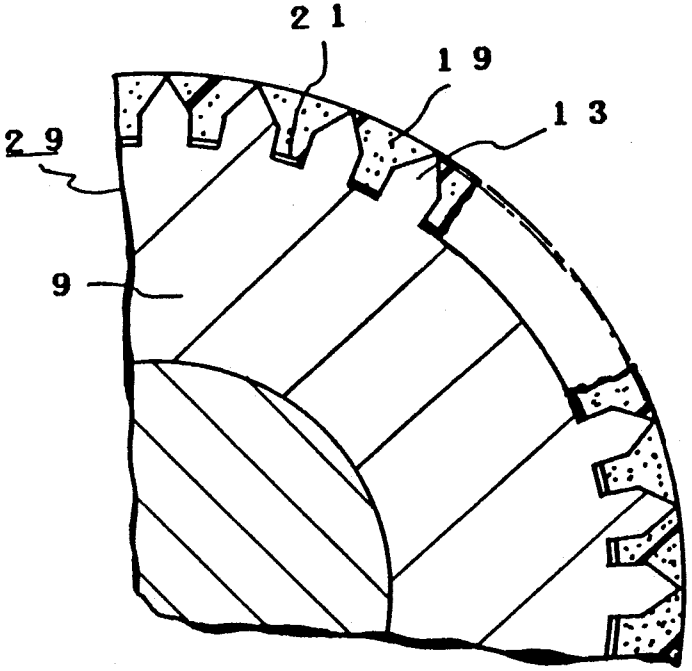
FIG. 2 is a transverse cross-sectional partial view of a toothed dehydrating roll used in the apparatus of FIG. 1 and having a novel elastic filling member.
Figure 8:
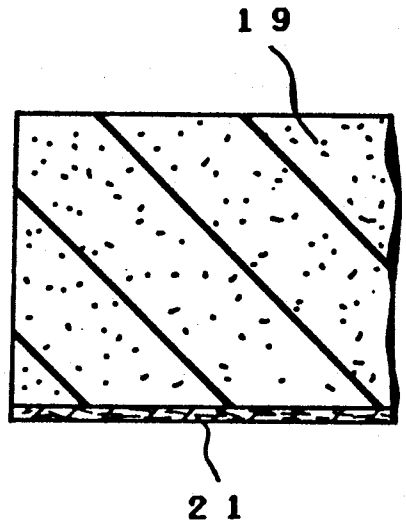
FIG. 8 is a partial cross-sectional view of a sheet of elastic filling member to be installed round the toothed dehydrating roll as shown in FIG. 2.

Referring now to FIGS. 2 and 8, each roll section 9 has an elastic filling member comprising a layer of elastic portion 19 made of sponge rubber and a layer of reinforcement portion 21 made of a woven fabric or cloth and secured by means of any suitable adhesive to the bottom surface of the elastic portion 19. As shown in FIG. 2, the reinforcement portion 21 of the elastic filler member is seated snugly onto the radially innermost peripheral surfaces between the projections 13 on the roll section 9 and the filler member has such a thickness that the radially outer surface of its sponge rubber portion 19 lies radially slightly further than the tip ends of the respective projections 13 when the elastic filling 19, 21 is fitted properly to fill the space. The sponge rubber for the elastic portion 19 should be of such a type that its pores are distributed discretely without communicating each other so that water is not absorbed by the sponge through its pores. The fabric for the reinforcement portion 21 should desirably be so woven as to provide a high tensile strength with little elasticity, and has on one side thereof an adhesive surface which is attached to the bottom surface of the sponge rubber sheet 19, as shown in FIG. 8. For example, a gummed cloth tape or sheet can serve for the purpose of the reinforcement portion 21 of the elastic filling member. Alternatively, the reinforcement portion 21 may be formed as an integral part of the elastic portion 19 thereby to constitute the elastic filler member.

Figure 5:
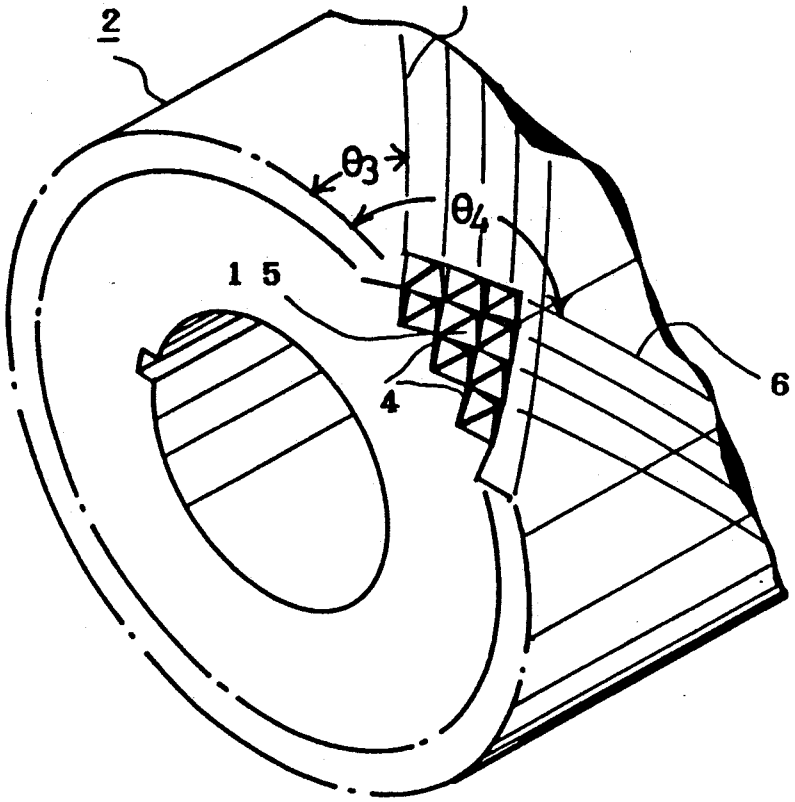
FIGS. 5 and 6 are perspective partial views illustrating the processes of forming the tooth-like projections on a steel roll.
Figure 6:
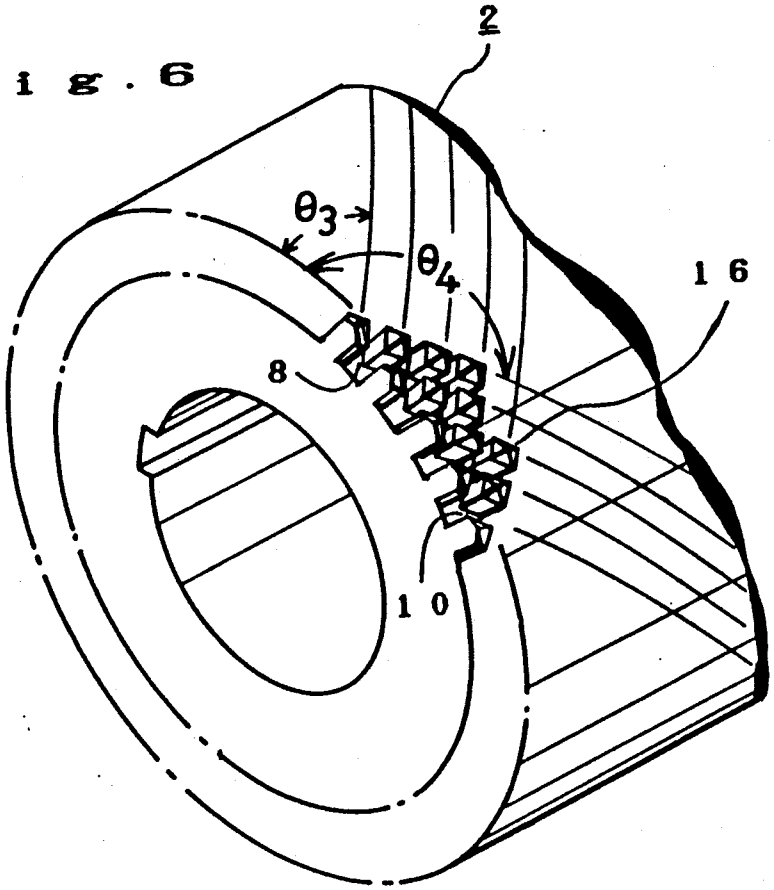
Figure 7:
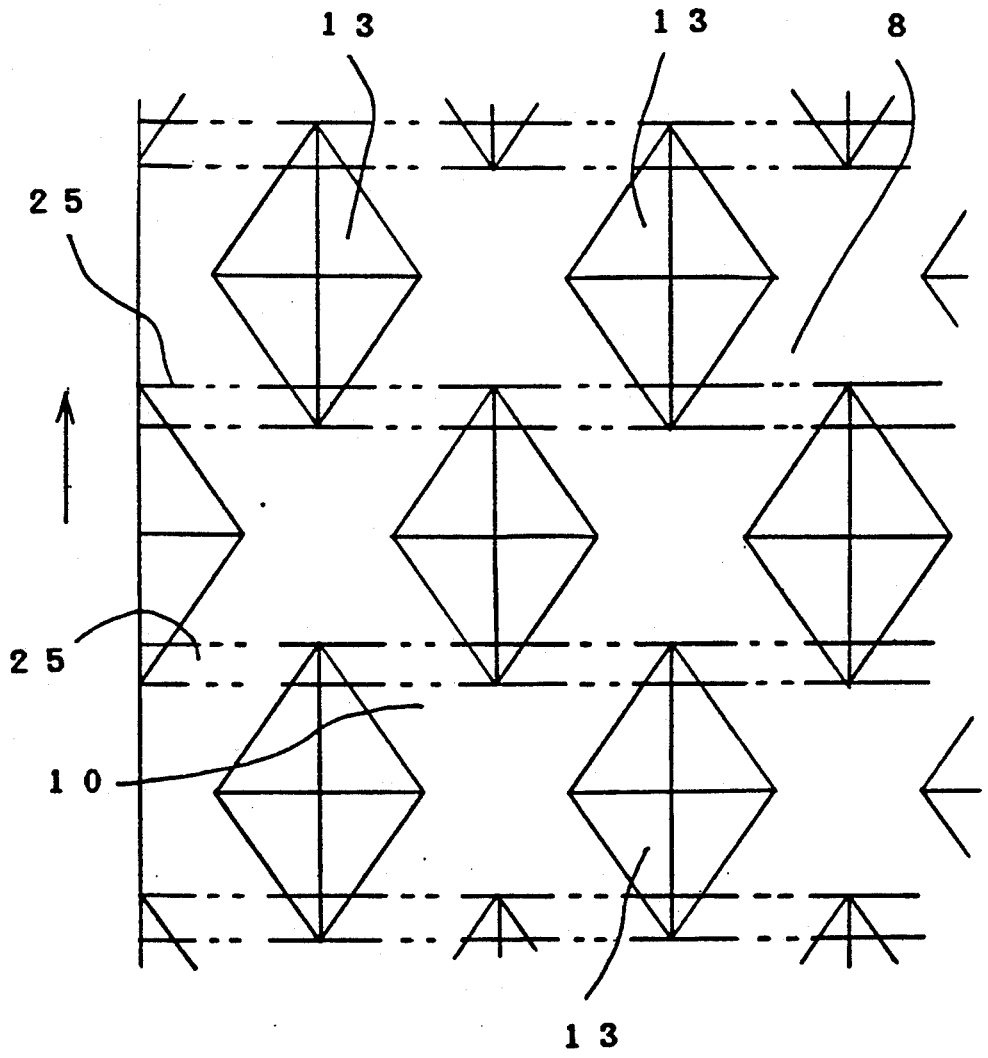
FIG. 7 is an illustrative enlarged view of part of the roll as seen toward the periphery thereof, showing the subsequent process of forming the projections on the steel roll.

The following will describe the processes of shaping the tooth-like projections 13 on each dehydrating roll section 9 used in the above embodiment of the invention, while having reference to FIGS. 5 to 7.

Referring firstly to FIG. 5, a cylindrical steel block 2 having an axial length of about 110 mm and a diameter of about 138 mm is prepared for each dehydrating roll section. Using an appropriate cutting tool on a milling machine, a first series of spiral V-grooves 4 with an angle of about 78° ($\theta 1$ shown in FIG. 4) and a depth of about 5.5 mm are cut at equal intervals, each starting from the edge on one end of the roll 2 at an angle ($\theta 3$) of about 35° with respect to that edge and extending spirally over the cylindrical surface of the roll to the edge on the opposite end thereof. In this cutting, as many as 35 V-grooves 4 can be formed at equally spaced intervals. Then, using the same cutter, a second series of spiral V-grooves 6 of the same number are cut extending from the same starting points as the respective first spiral grooves 4, but at an angle ($\theta 4$) of about 145° with respect to the above edge, as shown in FIG. 5. As a result, as many as 35 rows of projections 15 of a quadrilaterally pyramidal shape are formed over the periphery of the roll 2, each row comprising a plurality of such projections arranged in side-by-side relation along a spiral line extending at $\theta 3$ or $\theta 4$.

Then using another appropriate cutting tool, two series of spiral square grooves 8 and 10 are cut just between any two adjacent rows of projections along spiral lines at $\theta 3$ and $\theta 4$, respectively, with a width of about 2.55 mm and a depth of about 7 mm as measured from the vertices of the pyramidal projection 15 that correspond to the level of the original cylindrical surface of the roll 2. This groove cutting results in the formation of projections 16 as shown in FIG. 6, each comprising a combination of quadrilaterally pyramidal portion and proximal base portion.

Referring to schematic view of FIG. 7 showing diagrammatically part of the projections 13 (or 16) as seen toward the periphery of the roll 2, a series of axial cuts are made, as indicated by dash-and-dot lines 25, with a width of about 1 to 2 mm so that sharp corner edges are cut off on the leading and trailing sides of the base portion of each projection 15 with respect to the rotational direction of the dehydrating roll section 9 as indicated by arrow. These cuts are made with a depth just reaching the bottom surfaces of the grooves 8, 10. Thus, the tooth-like projections 13 in the embodiment are formed completely. The purpose of the axial cuts 25 will be described hereinafter. These steps of procedure are repeated for the remaining rolls 2.

Figure 3:
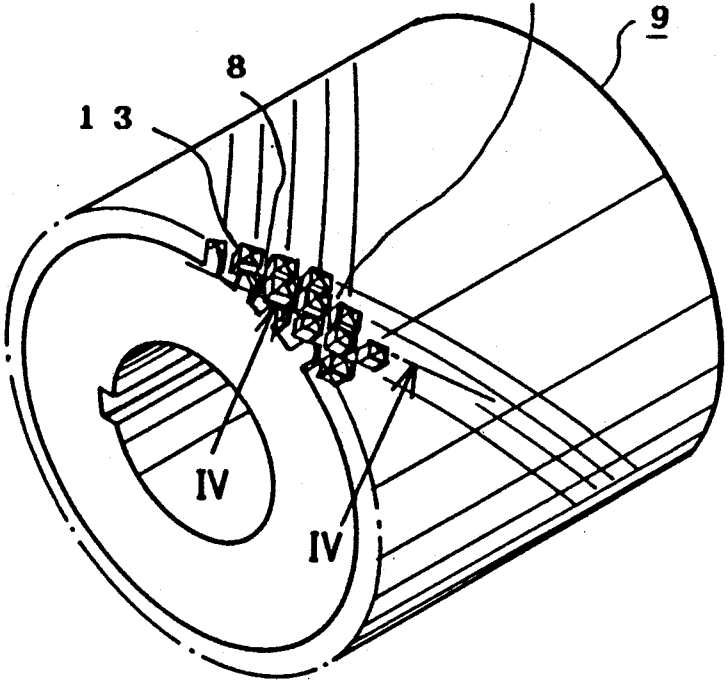
FIG. 3 is a perspective view of the toothed dehydrating roll of FIG. 2, showing partially the arrangement of tooth-like projections the roll, but with the elastic filling member removed therefrom.
Figure 4:
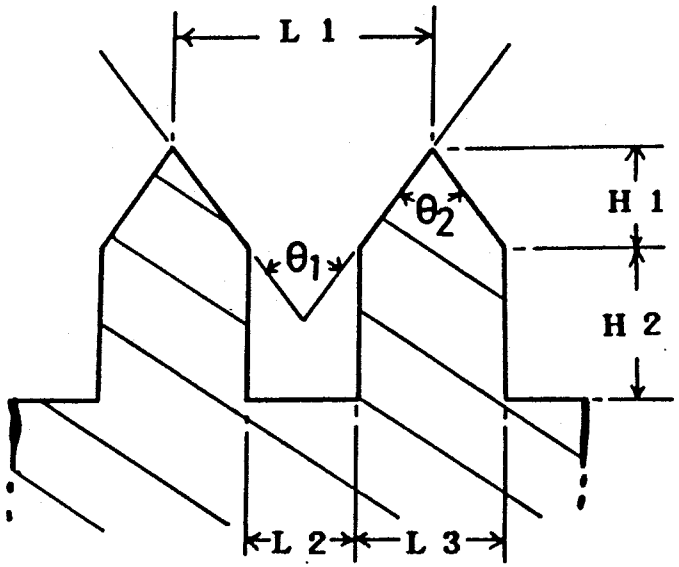
FIG. 4 is a sectional view showing dimensional relationship of two adjacent projections on the roll, said section being obtainable by cutting the roll along a spiral line IV—IV of FIG. 3 extending through the vertices of the two adjacent projections.

Now reference is made to FIG. 4 which provides dimensional relationship of two adjacent projections 13 shown in sectional view which is obtained by cutting the roll along a spiral line IV—IV of FIG. 3 extending through the vertices of the projections 13 along a spiral line at the angle ($\theta 4$) of 145°. In the diagram, L1 representing the distance between the vertices of the two adjacent projections is about 7 mm; L2 or the distance between facing surfaces of the base portions of the above two adjacent projections along the spiral line is about 3 mm; L3 or the thickness of the base portion of the projection as measured along the spiral line is about 4 mm; H1 representing the height of the pyramidal portion measures about 2.8 mm; H2 or the height of the base portion is about 4.2 mm. Angle $\theta 1$ formed by the first or second V-groove cutting is about 78°; and angle $\theta 2$ formed by the opposite sides of the pyramidal portion is about 71°.

The roll section 9 can be completed by addition of the fabric-reinforced elastic filling member 19, 21. The following will describe a method of installing the filling round the roll sections 9 while referring to FIG. 9. For the purpose of the description, it is understood that the elastic filling in the form of a sheet has a width of about 330 mm that is equal to the total axial length of combined three roll sections 9 and a length of about 433 mm that corresponds to the circumferential length of each roll section. In the drawing, reference symbol T shows part of a veneer sheet having substantially the same width dimension as the elastic filling sheet, a length of more than 433 mm, a thickness of about 3.4 mm. As shown, the veneer sheet T is placed on the sponge rubber sheet 19 with its fiber orientation directed along the length thereof and its leading end in registration with that of the elastic filling sheet 19, 21. With the toothed roll assembly 29 being driven to rotate in forward direction, the combination of the elastic filling sheet 19, 21 and veneer sheet T is inserted through the nip between the top pressing roll 7 and three adjacent roll sections 9 located at one end of the roll assembly 29. By so doing, the top pressing roll 7 cooperates with the veneer sheet T to force the elastic sheet 19, 21 against the projections 13, so that the pointed tip ends of the projections cut through the filling sheet and the latter sheet is pressed down until its enforcement portion 21 is seated firmly against the bottom surfaces of the grooves 8, 10 between the projections. After moving past the rolls, the sponge rubber portion 19 resumes its thickness by the virtue or its resiliency to such an extent that its outer surface lies radially slightly further than the tip ends of the respective projections 13. Thus, three roll sections 9 can be wrapped simultaneously with a single sheet of elastic filler member. The above procedure is repeated for the remaining roll sections 9 until the last three roll sections are clad with a similar elastic filling sheet.

As an alternative form of the elastic filling sheet, it may be provided with pre-cut holes, at least in its reinforcement portion 21, having a size slightly smaller than that of the projection and so positioned in the sheet that the holes coincide with the respective projections when the sheet has been installed round the roll section 9 in the same procedure as the above.

In operation, a green veneer sheet 5 passed through the rolls 7, 29 is subjected to compressive deformation by wedging action of the projections 13 then piercing into that sheet, which causes part of the water contained in the veneer to be squeezed out thereof. Because the sponge rubber 19 fills all the spaces between projections 13 and the veneer sheet is then pressed on its both surfaces by the rolls 7, 29, the water squeezed out of the veneer sheet from its opposite surfaces comes out toward the infeeding side of the rolls. Subsequently, the water flows along the periphery of the dehydrating roll 29 on the infeeding side to be dropped and received in the receptacle 23, from where the water is discharged through the outlet tube 23*a*. The squeezed water is thus prevented from being carried by the dehydrated veneer sheet and being attached to the sheet coming out of the dehydrating station.

As will be noted, the sponge rubber portion 19 of the elastic filler member tends to be displaced relative to the roll section 9 on which it is installed under the influence of pressures exerted by veneer sheet moving through the rolls. However, such displacement of the elastic rubber 19 is restricted by the reinforcement portion 21 which is seated firmly to the bottom surfaces of the grooves 8, 10 between the projections 13.

Referring to the axial cuts 25 (FIG. 7), these eliminate sharp edges on the leading and trailing corners of the base portion of each projection 13 as viewed in the rotational direction of the toothed roll 29, thereby making the sponge rubber portion 19 less susceptible to cutting action by the projections when it is pressed against such corners during dehydrating operation. Thus, these cuts can serve to improve the durability of the sponge rubber portion 19 of the elastic filler sheet.

The sponge rubber 19 will wear or otherwise deteriorate in a long period of use from various factors such as contacting pressures applied thereto by veneer sheets, attachment of water, etc. It may even incur a damage during dehydrating operation of such an extent that it needs be changed. Therefore, the elastic filling sheet 19, 21 should preferably be replaced with a new one on a periodical basis before it becomes unserviceable. To remove an old elastic filler sheet from the roll 29, one end of the sheet is just pulled out by hand and the entire sheet can be removed from the roll while being released from engagement with the projections 13. Because the sheet is reinforced at its back by fabric, the removal can be performed easily without breaking the sheet.

In the test operation of dehydrating green veneer of radiata pine (*Pinus radiata*) with a thickness of about 3.4 mm and an initial moisture of about 130%, it could be dehydrated to a final moisture content of about 70% without breaking knots in the sheet.

While the invention has been described and illustrated with reference to the specific embodiment, it is to be understood that the present invention can be practiced in various changes and modifications without departing from the spirit or scope thereof, as exemplified below.

Figure 10:
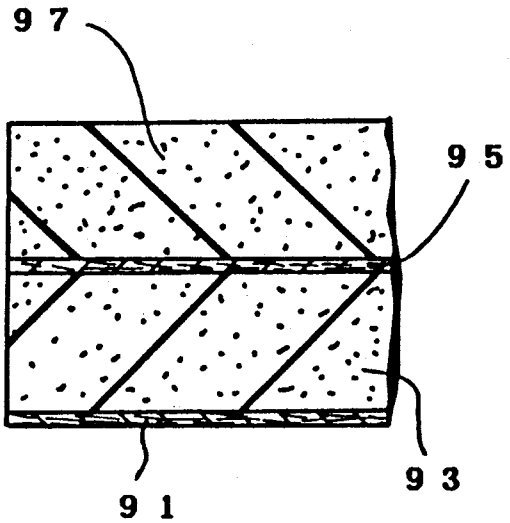
FIGS. 10 and 11 are partial cross-sectional views showing two different modified reinforced elastic filling members to be used in conjunction with the toothed dehydrating roll of the apparatus, respectively.

Referring to FIG. 10 showing a modified reinforced elastic filling, it includes two layers of sponge rubber portions 93, 97 and two sheets of reinforcement portions, one 91 secured to the back of the sponge rubber layer 93 and the other 95 interposed between the two layers of elastic portions. It is noted that the intermediate reinforcement sheet 95 has adhesive surfaces on its opposite sides to combine the elastic portions 93, 95 together.

Figure 11:
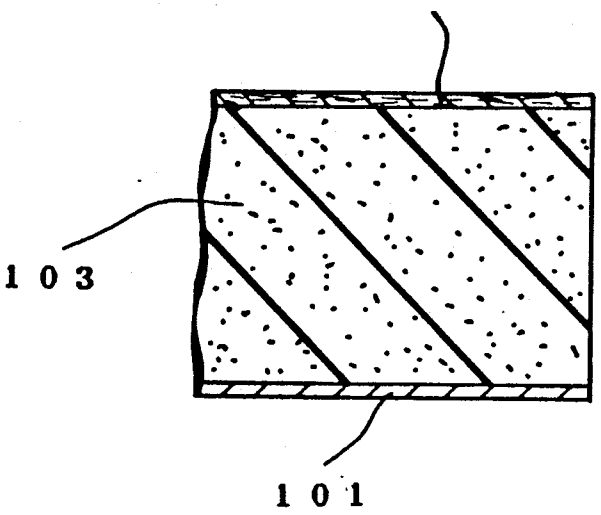

In another modification of the elastic filler member shown in FIG. 11, it comprising a sponge rubber portion 103 which is sandwiched by two reinforcement sheets 101, 105 attached on opposite surfaces of the elastic portion 103. The upper reinforcement sheet 105 can serve to protect the sponge rubber filling 103 from sharp side edges of the pyramidal portion of projection 13 which tend to cut the elastic filling. This filling member may be provided with a third intermediate reinforcement sheet such as 95 shown in FIG. 10.

Each of the roll section 9 may be formed with a less number of projections of the same shape as those shown in FIG. 3, e.g., as many as 31 rows of such projections along equally spaced spiral lines at $\theta 3$ or $\theta 4$ with the distance L1 (FIG. 4) of about 8 mm. Contrary to this, the roll section may have a greater number of projections. For example, using a tool for cutting a V-groove with an angle of about 71° ($\theta 1$) and a steel block with a diameter of about 160 mm, as many as 41 rows of projections along equally spaced spiral lines may be formed on each roll section. The use of such toothed roll can allow more projections to pierce into a knot in veneer sheet and the knot is less susceptible to breakage by piercing action of the projections. A toothed roll having a increased number of projections is thus advantageous in handling knotty veneer sheets.

As will be understood by those skilled in the art of veneer processing, the present invention is also applicable to a toothed roll used in a veneer tenderizing apparatus for flattening a wavy or curled veneer sheet by forming a number small cuts (or checks) in the sheet, as disclosed in, e.g., U.S. Pat. No. 4,850,404. That is, filling the spaces between the projections with elastic filling, the toothed tenderizing roll can be prevented from being clogged with wood chips or pieces which decrease the tenderizing efficiency. If the filling member is backed by a reinforcement sheet as shown in FIG. 8, removal and installation of the filling can be facilitated and the aforementioned elastic displacement of the filling member relative to the roll during operation can be restricted as described hereinbefore.

What is claimed is:

1. A veneer dehydrating apparatus comprising a pair of rolls rotatable on the axes thereof and disposed so as to form a nip therebetween along the axial length thereof, means for feeding green veneer sheets successively into said nip, at least one of said rolls having a number of tooth-like projections formed over the periphery thereof and separated from one another by grooves formed on said periphery, each of said projections being pierceable into a veneer sheet for squeezing out part of water contained in the veneer by compression exerted thereto by the projection piercing thereinto, said one roll having an elastic filling member fitted thereround so as to fill the spaces between the projections, said elastic filling member comprising an elastic portion and at least one layer of reinforcement portion secured to one surface of said elastic portion and detachably seated against the radially innermost surfaces of said grooves.

2. A veneer dehydrating apparatus according to claim 1, wherein said elastic filling member is in the form of a sheet having such a thickness that its radially outer surface lies radially slightly further than the tip ends of said respective projections when fitted to fill the space.

3. A veneer dehydrating apparatus according to claim 1, wherein said elastic portion of the filling member is made of sponge rubber of such a type that its pores are distributed discretely without being connected to each other so that water is not absorbed thereby through the pores.

4. A veneer dehydrating apparatus according to claim 1, wherein said reinforcement portion is made of a sheet of fabric having on one side thereof an adhesive surface which is attached to one side of said elastic portion thereby forming said elastic filling member.

5. A veneer dehydrating apparatus according to claim 1, wherein said reinforcement portion is made of a sheet of fabric which is formed integrally with said elastic portion thereby forming said elastic filling member.

6. A veneer dehydrating apparatus according to claim 1, wherein said elastic portion includes two elastic layers and said elastic filling member further includes a second reinforcement portion lying intermediate of and secured on both surfaces thereof to said two layers.

7. A veneer dehydrating apparatus according to claim 1, wherein said elastic filling member further includes a second reinforcement portion lying on the opposite side of said elastic portion with respect to the first reinforcement portion.

8. A veneer dehydrating apparatus according to claim 1, wherein said one roll comprises a plurality of roll sections each having a number of said tooth-like projections, which are axially aligned and combined together.

* * * * *